US009216797B2

(12) United States Patent
Lif et al.

(10) Patent No.: US 9,216,797 B2
(45) Date of Patent: Dec. 22, 2015

(54) FRAMEWORK WITH A BUOYANT BODY FOR A SUBSEA VEHICLE AS WELL AS A METHOD FOR CONSTRUCTION OF A FRAMEWORK

(75) Inventors: Arne Ingemar Lif, Stavanger (NO); Evind Myhre, Algard (NO); Tor Gunnar Alvestad, Bryne (NO)

(73) Assignee: IKM Subsea AS, Bryne (NO)

( * ) Notice: Subject to any disclaimer, the term of this patent is extended or adjusted under 35 U.S.C. 154(b) by 63 days.

(21) Appl. No.: 13/641,238

(22) PCT Filed: May 5, 2011

(86) PCT No.: PCT/NO2011/000143

§ 371 (c)(1),
(2), (4) Date: Nov. 5, 2012

(87) PCT Pub. No.: WO2011/139157

PCT Pub. Date: Nov. 10, 2011

(65) Prior Publication Data

US 2013/0199434 A1 Aug. 8, 2013

(30) Foreign Application Priority Data

May 5, 2010 (NO) ..... 20100650
Mar. 25, 2011 (NO) ..... 20110455

(51) Int. Cl.
*B63B 3/13* (2006.01)
*B63B 22/00* (2006.01)

(52) U.S. Cl.
CPC . *B63B 3/13* (2013.01); *B63B 22/00* (2013.01); *Y10T 29/49622* (2015.01)

(58) Field of Classification Search
CPC ..... B63B 22/00; B63G 8/00
USPC ..... 114/312; 441/33
See application file for complete search history.

(56) References Cited

U.S. PATENT DOCUMENTS 3,436,775 A * 4/1969 Schlosser et al. ..... 441/33
7,121,767 B1 10/2006 Watkins

FOREIGN PATENT DOCUMENTS

CN 1922073 2/2007
WO 99/44881 A1 9/1999

OTHER PUBLICATIONS

Jane's Underwater Security Systems and Technology Aug. 1, 2008 http://articlesjanes.com/art cles/Janes-Underwater-Security-Systems-and-Technology/Mini-Astrix_Norway.html.
International Search Report for parent application PCT/NO2011/000143, having a mailing date of Jul. 21, 2011.

(Continued)

*Primary Examiner* — Lars A Olson
(74) *Attorney, Agent, or Firm* — Andrus Intellectual Property Law, LLP

(57) ABSTRACT

A frame is for a remotely operated vehicle. Several frame elements provide a carcass formed of a buoyant material. The frame elements are provided by a curable material having been arranged on the surfaces of the carcass, forming a rigid shell around the carcass. A method of constructing a frame is for a remotely operated vehicle. Several frame elements provide a carcass formed of a buoyant material. The method comprises: forming several core elements of a buoyant material; forming a carcass by joining the core elements together; applying a curable material to the surface of the carcass; and forming several mounts integrated into the curable material, for vehicle components.

20 Claims, 2 Drawing Sheets

(56) References Cited

OTHER PUBLICATIONS

Written Opinion for parent application PCT/NO2011/000143, having a mailing date of Jul. 21, 2011.
Applicant's Response of Oct. 12, 2011 to Written Opinion for parent application PCT/NO2011/000143, having a mailing date of Jul. 21, 2011.
Written Opinion for parent application PCT/NO2011/000143, having a mailing date of Nov. 18, 2011.
Preliminary Report on Patentability for parent application PCT/NO2011/000143, having a completion date of Apr. 30, 2012.
International Preliminary Report on Patentability for parent application PCT/NO2011/000143, having a completion date of Apr. 30, 2012.

* cited by examiner

FRAMEWORK WITH A BUOYANT BODY FOR A SUBSEA VEHICLE AS WELL AS A METHOD FOR CONSTRUCTION OF A FRAMEWORK

CROSS-REFERENCE TO RELATED APPLICATIONS

This application is the U.S. national stage application of International Application PCT/NO2011/000143, filed May 5, 2011, which international application was published on Nov. 10, 2011, as International Publication WO 2011/139157 in the English language. The International Application claims priority of Norwegian Patent Application 20100650, filed May 5, 2010 and Norwegian Patent Application No. 20110455, filed Mar. 25, 2011.

BACKGROUND OF THE INVENTION

A device for a hull of a remotely operated vehicle is described, in which several frame elements provided by a curable material form a frame, the frame elements containing a carcass formed of a buoyant material. A method of forming the hull is described as well.

When building a remotely operated vehicle (ROV) which is to operate at great water depths, of several thousand meters, that is to say, it is of vital importance that the structure is strong enough to withstand the high water pressure to which the vehicle may be exposed. At the same time, the vehicle must exhibit sufficient buoyancy, and the framework (hull) must be able to accommodate the equipment with which the vehicle is to be fitted out.

It is known to provide the necessary buoyancy in the form of one or more blocks formed of a suitable buoyant material on the vehicle frame, for example on the top of the frame. It is also known to use gas-filled compartments in the frame, for example by the frame being formed, at least partially, of closed pipes. The drawback of gas-filled compartments is that it is difficult for them to withstand the extremely high pressure to which the ROV is exposed at the water depths that are relevant today. Attempts have therefore been made to fill frame pipes with buoyancy means which can exhibit sufficient compressive strength. It is known to fill frame pipes with a liquid material which, after setting, exhibits a suitable specific weight and sufficient compressive strength. Examples of such materials are lightweight concrete and expanding plastics. It turns out that under the prevailing conditions, such materials do not have the properties required. Among other things, the closed volumes will result in expansion, curing et cetera not developing in the same way as when the materials can be vented and moisture, solvents et cetera may be carried away.

SUMMARY OF THE INVENTION

The invention has for its object to remedy or reduce at least one of the drawbacks of the prior art, or at least provide a useful alternative to the prior art.

The object is achieved through features which are specified in the description below and in the claims that follow.

The invention provides a frame for a remotely operated vehicle formed as a truss work, a hull or the like and substantially made up of cylinder- or block-shaped elements formed of a core material with a specific weight sufficient to provide prescribed vehicle buoyancy and with a compressive strength sufficient to withstand a specific water head pressure. The frame may typically be dimensioned for a water head pressure of at least 3000 m, but it is obvious to choose a core material with other properties if the frame is to be exposed to a different maximum pressure. Preferably, the core material is formed of polymerized foam, for example as an epoxy matrix with closed pores formed by microspheres of glass. The specific weight of the core material is preferably in the range of 60-710 kg/m$^3$, more advantageously in the range of 350-600 kg/m$^3$, and even more advantageously in the range of 450-550 kg/m$^3$, and the compressive strength of the material is preferably in the range of 20-80 MPa, more advantageously 35-45 MPa. The cylinder- or block-shaped elements are covered with a jacket preferably formed of a reinforced plastic composition, typically a multi-layer, fluid-tight, fibre-glass-reinforced plastic.

The frame is formed by worked elements of the core material being put together into a shape corresponding to the general shape of the frame, for example the supporting elements, oblique stays and stay bars. The core material elements are joined together by gluing, for example. In portions needing reinforcements, for example at cross-sectional reductions, or where load is to be anchored, reinforcing elements of some material, for example a carbon-fibre-reinforced material, steel et cetera, may be integrated. The complete frame-shaped body made up of core material elements is then clad with a shell which is formed of a curable material, typically a fluid, curable plastic composition, is being applied, being reinforced with layers of reinforcing fabric in such a way as that known to a person skilled in the art of fibre-glass-reinforced plastics or the equivalent. In the course of the construction of the closed shell, the necessary mounts for components which are to be mounted on the completed frame, for example projecting lugs, plates et cetera, are formed.

In a first aspect, the invention relates more specifically to a frame for a remotely operated vehicle, in which several frame elements provide a carcass formed of a buoyant material, characterized by the frame elements being provided by a curable material being arranged on the surfaces of the carcass, forming a tight, rigid shell around the carcass.

The carcass may be provided by several core elements formed of a block material of polymerized foam. More specifically, the block material may be an epoxy matrix with closed pores formed by microspheres of glass. This is a group of materials which are easy to shape and exhibit suitable material properties.

The specific weight of the core material may be in the range of 60-710 kg/m$^3$, more advantageously 350-600 kg/m$^3$, and even more advantageously in the range of 450-550 kg/m$^3$. The compressive strength of the material may be in the range of 20-80 MPa, more advantageously 35-45 MPa. The core material will thereby be able to withstand the prevailing water pressure at great sea depths with a shell of moderate thickness.

The carcass may be provided by several core elements which are joined together by means of means taken from the group consisting of adhesives and rod- and plate-shaped connecting elements. Thereby possibilities are provided for a rational and quick construction of the carcass.

The carcass may include one or more reinforcing elements formed of a material different from the core material. Thereby the hull may be formed with a narrowing et cetera for optimum adaptation to the components that are to be fitted into it.

The curable material may be a reinforced plastic composition. More specifically, the reinforced, curable plastic composition may include several layers of fibre glass fabric. Such materials provide good possibilities for reinforcing element transitions, are weight-saving and require little maintenance.

In a second aspect, the invention relates more specifically to a method of constructing a frame for a remotely operated vehicle, in which several frame elements form a carcass provided by a buoyant material, characterized by the method including the following steps:

forming several core elements of a buoyant material;

forming a carcass by joining the core elements together;

applying a curable material to the surface of the carcass; and forming, integrated into the curable material, several mounts for vehicle components.

The method may alternatively include:

forming one or more frame sections by joining the respective core elements together and applying the curable material to at least part of the surface of the carcass;

joining the frame sections and the remaining core elements together;

applying the curable material to the non-covered surfaces of the core elements; and forming element connections between the frame sections and the adjacent frame elements by means of the curable material. Parts of the frame may thereby be prefabricated, jigs may be used, and frame sections may be stored temporarily, with a reduced need for storage volume.

The carcass may be provided by several core elements formed of a block material of polymerized foam. More specifically, the block material may be an epoxy matrix with closed pores formed by microspheres of glass.

The specific weight of the core material may be in the range of 60-710 kg/m$^3$, more advantageously 350-600 kg/m$^3$, and even more advantageously in the range of 450-550 kg/m$^3$. The compressive strength of the material may be in the range of 20-80 MPa, more advantageously 35-45 MPa.

The carcass may be provided by several core elements being joined together by means of means taken from the group consisting of adhesives and rod- and plate-shaped connecting elements.

The carcass may be reinforced by one or more reinforcing elements formed of a material different from the core material being integrated into the carcass.

The curable material may be a reinforced plastic composition which includes several crossed layers of fibre glass fabric.

BRIEF DESCRIPTION OF THE DRAWINGS

In what follows, an example of a preferred embodiment is described, which is visualized in the accompanying drawings, in which.

DETAILED DESCRIPTION OF THE INVENTION

Figure 3:
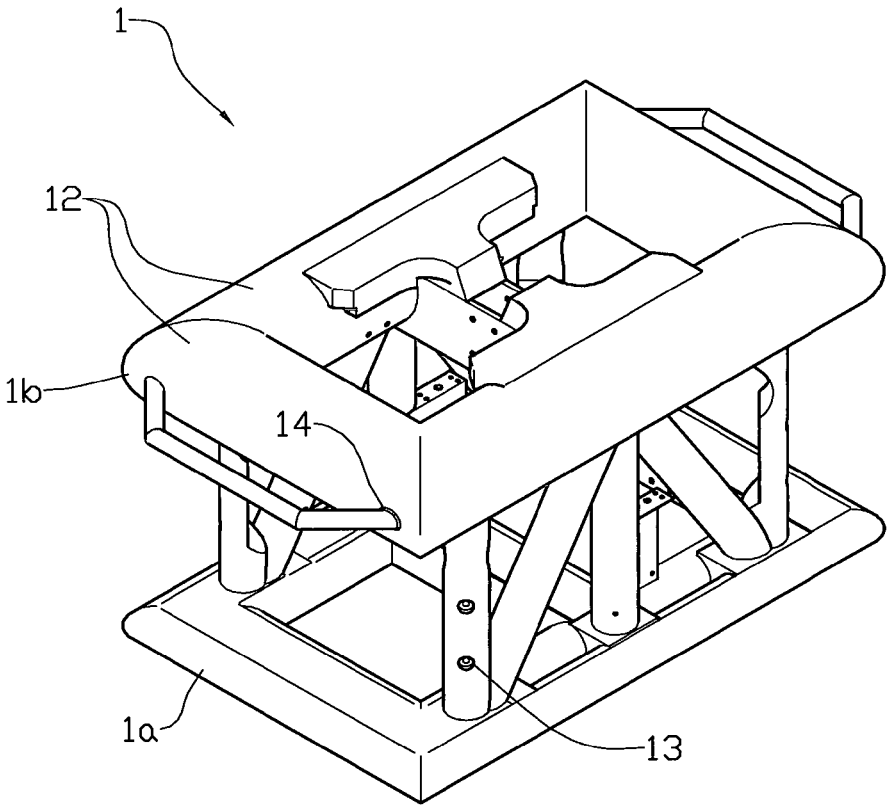
FIG. 3 shows, on the same scale as FIG. 1, a complete frame, in which the carcass is covered by a reinforced plastic composition.

In FIG. 3 the reference numeral 1 indicates a frame comprising several frame elements 12 and component mounts 13 arranged to provide the necessary buoyancy volume, carrying capacity, rigidity, attachment surfaces et cetera to fix, carry and accommodate the components (not shown) included in a remotely operated vehicle (ROV) known per se.

Figure 1:
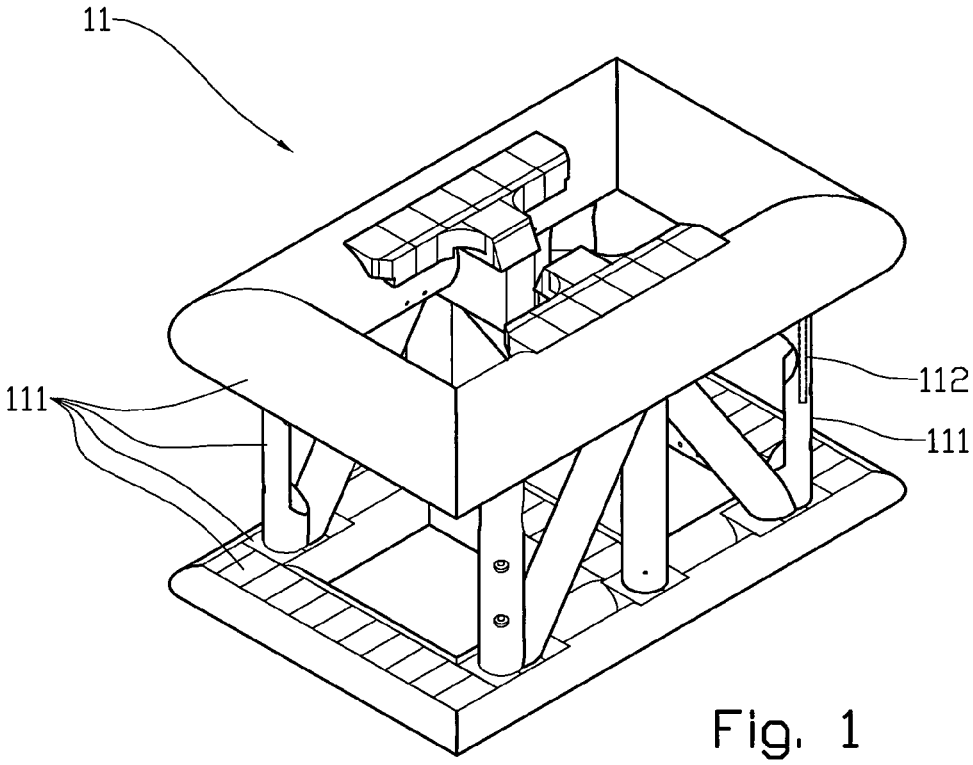
FIG. 1 shows in perspective an assembled carcass for a frame formed as a truss work.
Figure 2:
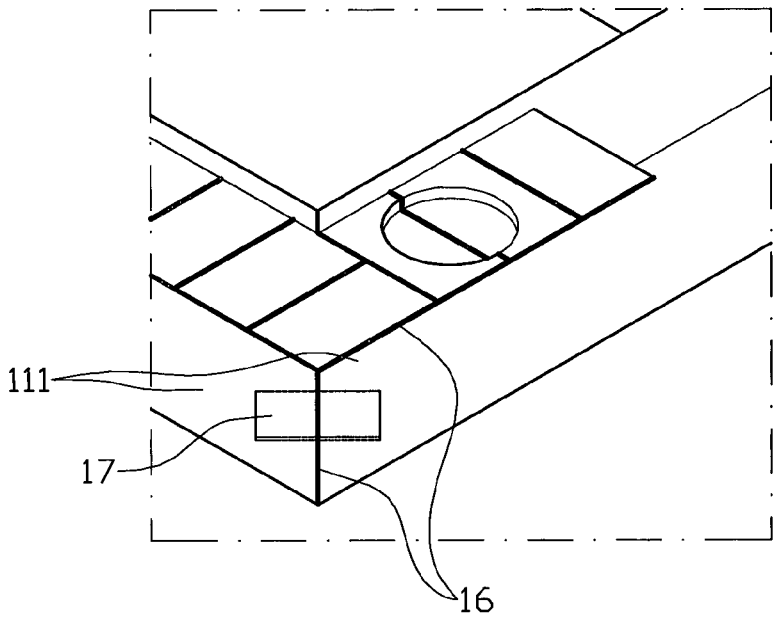
FIG. 2 shows, on a larger scale, a section of the assembled carcass.

Reference is then made to FIG. 1, in which a carcass 11 is shown, made up of a number of core elements 111 shaped substantially in accordance with the shape of the frame 1. The core elements 111 are formed of a pore-filled block material of a prescribed specific weight and compressive strength, for example SF300* from BMTI, La Seyne-sur-Mer, France. The material is chosen on the basis of the maximum water depths for which the ROV is dimensioned. The example of material type mentioned has a specific weight in the range of 450-550 kg/m$^3$, and the compressive strength of the material is in the range of 35-45 MPa. Prior to the joining-up, the core elements 111 have been machined in accordance with the shape of the frame 1 and so that the core elements 111 mutually engage in a locking manner. The core elements 111 are preferably fixed to each other by means of a suitable adhesive 16, possibly complemented by the use of, for example, rod- or plate-shaped connecting elements 17 which are anchored to or embedded in the core elements 111. When necessary, for example in portions in which cross-sectional reductions are necessary on account of the attachment of components (not shown) on the frame 1, reinforcing elements 112 have been fitted, which are anchored to the carcass 11 and/or to a frame element 12 surrounding a portion of the carcass 11.

Figure 4:
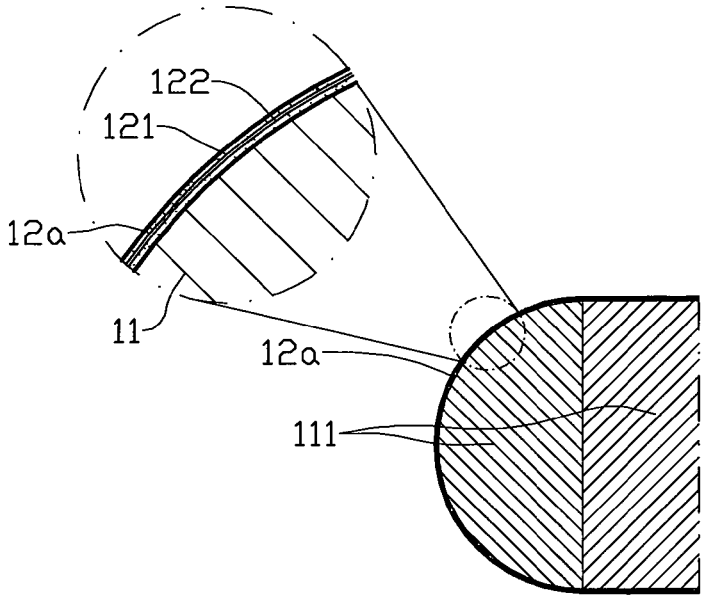
FIG. 4 shows, on a larger scale, a cross section of a portion of a frame element.

The frame elements 12 are formed by a shell 12*a* being built up around the carcass 11, see FIG. 4, a plastic composition 121 reinforced with a suitable material 122, for example one or more types of fibre glass fabric, being applied to the surfaces of the carcass 11. At the transitions between different frame elements 12, element connections 14 are formed out of the same type of materials 121, 122 as said materials 121, 122 are being applied, in a manner known per se, sufficiently far in on said frame elements 12. The frame elements 12 and the element connections 14 all fit tightly around the carcass 11.

The frame elements 12 and the element connections 14 together form the bearing structure of the frame 1, whereas the carcass 11 fills in substantially all the cavities of the frame 1, providing a compressively strong support for all the frame elements 12.

Parts of a frame element 12 may be provided by pre-shaped shells (not shown) which are complementary to the core element 11 to be clad. Several shells may be joined together by means of said reinforced plastic composition 121, 122, and they may be combined with reinforced plastic composition 121, 122 which is applied directly to the surface of the core elements 111.

The component mounts 13 are integrated in the frame by suitable attachment details, for example formed of metal, being anchored in the reinforced plastic composition 121, 122 and partly surrounded by the plastic composition 121, 122, possibly also extending into the adjacent core element 111 for the desired stability to be achieved.

The completed frame 1 provides a shell which fits tightly around the carcass 11 which in turn provides sufficient support for all parts of the frame 1 and prevents the frame 1 from collapsing when exposed to great water pressures. At the same time, space is provided for installing ROV components where, conventionally, buoyancy bodies have been placed, the buoyancy bodies now being constituted by the frame 1 itself.

It is within the scope of the invention first to form one or more frame sections 1*a*, 1*b* by joining the respective core elements 111 together and at least cover these with the plastic composition 121, 122 in order, then, to join the frame section(s) 1*a*, 1*b* to the remaining core elements 111 and then apply the plastic composition 121, 122 to the non-covered portions of the carcass 11 with sufficient overlap with the frame sections 1*a*, 1*b* covered earlier.

The invention claimed is:

1. A method of constructing a frame for a remotely operated vehicle, in which several frame elements provide a carcass formed of a buoyant material, the method comprising:

forming several core elements of a buoyant material;

forming a carcass by joining the core elements together;

applying a curable material to the surface of the carcass; and forming several mounts integrated into the curable material, for vehicle components.

2. The method in accordance with claim 1, wherein the method further comprises:

forming one or more frame sections by joining the respective core elements together and applying the curable material to at least part of the surface of the carcass;

joining, the frame sections and the remaining core elements together;

applying, the curable material to the non-covered surfaces of the core elements; and forming element connections between the frame sections and the adjacent frame elements by means of the curable material.

3. The method in accordance with claim 1, wherein the carcass is provided by several core elements formed of a block material of polymerized foam.

4. The method in accordance with claim 1, wherein the carcass is provided by several core elements formed of a block material of an epoxy matrix with closed pores formed by microspheres of glass.

5. The method in accordance with claim 3, wherein the specific weight of the core material is in the range of 60-710 $kg/m^3$.

6. The method in accordance with claim 3, wherein the compressive strength of the core material is in the range of 20-80 MPa.

7. The method in accordance with claim 1, wherein the carcass is provided by several core elements being joined together by means selected from a group consisting of adhesives and rod- and plate-shaped connecting elements.

8. The method in accordance with claim 1, wherein the carcass is reinforced by one or more reinforcing elements, which have been formed of a material different from the core material, being integrated into the carcass.

9. The method in accordance with claim 1, wherein the curable material is a reinforced plastic composition which includes several layers of crossed fibre glass fabric.

10. The method in accordance with claim 3, wherein the specific weight of the core material is in the range of 350-600 kg/m3.

11. The method in accordance with claim 3, wherein the specific weight of the core material is in the range of 450-550 kg/m3.

12. The method in accordance with claim 3 wherein the compressive strength of the core material is in the range of 35-45 MPa.

13. A method of constructing a frame for a remotely-operated vehicle, the method comprising: forming a plurality of core elements out of a buoyant material; forming a carcass by joining the core elements together; applying a curable material to an outer surface of the carcass; and integrating several mounts into the curable material, for mounting vehicle components.

14. The method in accordance with claim 13, further comprising forming a frame section out of the carcass for the remotely-operated vehicle.

15. The method in accordance with claim 14, further comprising using the curable material to connect the frame section to an adjacent frame section.

16. The method in accordance with claim 13, wherein the buoyant material is a polymerized foam.

17. The method in accordance with claim 13, wherein the buoyant material is an epoxy matrix with closed pores formed by microspheres of glass.

18. The method in accordance with claim 13, further comprising joining the core elements together with a fastener selected from a group consisting of an adhesive, a rod-shaped connecting element, and a plate-shaped connecting, element.

19. The method in accordance with claim 13, further comprising reinforcing the carcass with one or more reinforcing elements that are formed of a material different than the core material and that are integrated into the carcass.

20. The method in accordance with claim 13, wherein the curable material is a reinforced plastic composition comprising several layers of fiber glass fabric.

* * * * *